US010213754B2

(12) United States Patent
Jobling

(10) Patent No.: US 10,213,754 B2
(45) Date of Patent: Feb. 26, 2019

(54) MIXING APPARATUS

(71) Applicant: Challenging Innovation Limited, Whitley Bay, Tyle & Wear (GB)

(72) Inventor: John Edward Jobling, Wylam (GB)

(73) Assignee: Challenging Innovation Limited, Whitley Bay (GB)

( * ) Notice: Subject to any disclaimer, the term of this patent is extended or adjusted under 35 U.S.C. 154(b) by 180 days.

(21) Appl. No.: 15/505,662

(22) PCT Filed: Aug. 21, 2015

(86) PCT No.: PCT/GB2015/000247
§ 371 (c)(1),
(2) Date: Feb. 22, 2017

(87) PCT Pub. No.: WO2016/027051
PCT Pub. Date: Feb. 25, 2016

(65) Prior Publication Data
US 2017/0232408 A1 Aug. 17, 2017

(30) Foreign Application Priority Data
Aug. 22, 2014 (GB) ..... 1414940.5

(51) Int. Cl.
*B28C 5/12* (2006.01)
*B28C 5/16* (2006.01)
(Continued)

(52) U.S. Cl.
CPC ..... *B01F 7/0065* (2013.01); *B01F 7/001* (2013.01); *B01F 7/003* (2013.01); *B01F 7/0005* (2013.01);
(Continued)

(58) Field of Classification Search
CPC ..... B01F 13/0028; B01F 2215/0047; B01F 7/00033; B01F 7/00041; B01F 7/0005;
(Continued)

(56) References Cited

U.S. PATENT DOCUMENTS 1,159,080 A * 11/1915 Poggensee ..... B01F 7/00208 366/276
1,227,671 A * 5/1917 Robertson ..... B01F 7/00066 366/197
(Continued)

FOREIGN PATENT DOCUMENTS

CN 202878486 U 4/2013
CN 202985780 U 6/2013
(Continued)

*Primary Examiner* — Tony G Soohoo
(74) *Attorney, Agent, or Firm* — James Creigton Wray

(57) ABSTRACT

There is provided apparatus (301) for mixing contents of a receptacle, the apparatus comprising a rotary shaft (302) equipped at a proximal end with a connection for removable attachment to a means of providing rotation. The rotary shaft has a mixing element (303) fixedly connected at a distal end of the shaft opposite to said proximal end. The mixing element comprises at least two arms (304) at the distal most end of the shaft, a corkscrew neck (306) on the shaft and a collar (305) on the shaft positioned in between the at least two arms and the corkscrew neck. The at least two arms are configured in a first partially-open resting position and are moveable to a second fully-open operative position. The mixing element further comprises a blade (307) positioned across the shaft more proximally than the corkscrew neck.

15 Claims, 8 Drawing Sheets

(51) Int. Cl.
*B01F 7/00* (2006.01)
*B01F 13/00* (2006.01)

(52) U.S. Cl.
CPC ..... *B01F 7/00033* (2013.01); *B01F 7/00041* (2013.01); *B01F 7/00066* (2013.01); *B01F 7/00291* (2013.01); *B01F 7/00408* (2013.01); *B01F 7/00583* (2013.01); *B01F 7/00725* (2013.01); *B01F 13/0028* (2013.01); *B28C 5/12* (2013.01); *B28C 5/1223* (2013.01); *B28C 5/16* (2013.01); *B01F 2215/0047* (2013.01)

(58) Field of Classification Search
CPC .. B01F 7/00066; B01F 7/001; B01F 7/00291; B01F 7/003; B01F 7/00408; B01F 7/00583; B01F 7/0065; B01F 7/00725; B28C 5/12; B28C 5/1223; B28C 5/16
USPC ..... 366/242–243, 308
See application file for complete search history.

(56) References Cited

U.S. PATENT DOCUMENTS 1,436,172 A * 11/1922 Holmgren ..... B01F 7/00066 366/251
2,162,348 A * 6/1939 Hacmac ..... A47J 43/105 222/189.07
2,207,335 A * 7/1940 Thomas ..... A01J 13/00 366/242
2,561,258 A * 7/1951 Wolf ..... B01F 7/00066 222/406
2,641,412 A * 6/1953 Byberg ..... A01K 39/01 241/245
2,702,693 A * 2/1955 Kay ..... A61L 2/02 366/243
2,896,925 A * 7/1959 Place ..... B01F 7/00475 366/331
3,204,283 A * 9/1965 Damron ..... A45D 34/048 366/243
3,223,389 A * 12/1965 Simmonds ..... B01F 13/002 366/282
3,326,533 A * 6/1967 Sturrup ..... A45D 34/048 366/242
3,455,540 A * 7/1969 Marcmann ..... B01F 7/00066 366/129
3,559,962 A * 2/1971 Enssle ..... B01F 7/00066 366/308
3,734,643 A * 5/1973 Wallin ..... B01F 7/00583 416/202
3,764,101 A * 10/1973 Wallin ..... B01F 7/00583 249/160
3,991,983 A * 11/1976 Drynan ..... A47J 43/1087 366/129
4,083,653 A * 4/1978 Stiffler ..... B01F 7/00066 366/308
4,095,919 A * 6/1978 Ehrenskjold ..... B63H 1/24 416/140
4,396,291 A * 8/1983 Simmonds ..... B01F 13/002 361/92
4,981,367 A * 1/1991 Brazelton ..... B01F 13/002 366/251
5,073,033 A * 12/1991 Klepeis ..... B01F 7/001 366/129
5,192,131 A * 3/1993 Hatfield ..... B01F 7/00058 366/308
5,584,112 A * 12/1996 Diore ..... A47J 43/0711 264/263
5,938,325 A * 8/1999 Edwards ..... B01F 7/00066 366/129
5,941,636 A * 8/1999 Lu ..... B01F 7/00066 366/249
6,247,837 B1 * 6/2001 Wardberg ..... B01F 7/00066 366/129
6,273,601 B1 8/2001 Hlavka
6,394,640 B1 5/2002 Astegno
6,419,385 B1 * 7/2002 Walls ..... B01F 7/1695 366/247
7,441,940 B2 * 10/2008 Vanek ..... B01F 7/00075 366/129
9,713,799 B2 * 7/2017 Mattson ..... B01F 7/00058
2005/0083782 A1 * 4/2005 Gronau ..... B01F 7/00016 366/310
2015/0165396 A1 * 6/2015 Mattson ..... B01F 7/00058 366/279

FOREIGN PATENT DOCUMENTS

CN 103568119 A 2/2014
EP 2638955 A1 * 9/2013 ..... B01F 7/00041
EP 2638955 A1 9/2013
GB 771156 A 3/1957
GB 2116864 A 10/1983
GB 2427905 A 1/2007
WO 2004078330 A1 9/2004
WO WO-2013136038 A1 * 9/2013 ..... B01F 7/00041

* cited by examiner

MIXING APPARATUS

CROSS REFERENCE TO RELATED APPLICATIONS

This application claims priority from United Kingdom Patent Application No. 1414940.5, filed 22 Aug. 2014, the entire disclosure of which is incorporated herein by reference in its entirety.

BACKGROUND OF THE INVENTION

1. Field of the Invention

The present invention relates to an improved mixing tool, and in particular to a mixing tool for thoroughly stirring plaster during plaster preparation.

2. Description of the Related Art

EP2638955A1 describes the mixing of contents of a receptacle using a device comprising at least two arms, wherein the at least two arms may be retracted when in a resting position or may extend radially outwardly when in an operative rotating position. Said device further comprises a corkscrew neck positioned above the at least two arms and a collar positioned above the at least two arms and beneath the corkscrew neck. A means of providing rotation may be provided by a handheld drill or an electric screwdriver. EP2638955A1, however, has two associated problems. Firstly, when mixing the contents of a receptacle, unmixed ingredients such as dry plaster may remain on the surface of the mixture in the receptacle. Secondly, a high speed drill needs to be used in conjunction with the mixing tool. This precludes use of the device by a large proportion of the domestic market which does not possess a high speed drill and which would be unwilling to obtain one for the sole purpose of using it as a component for a mixing tool.

Paddle-type plaster mixers are commonly used in the industry. However, such prior art plaster mixers take a relatively long time to mix the plaster and water and in any case, do not thoroughly do so, leaving unmixed plaster on the sides of the mixing container. They are also very difficult to clean after use if not cleaned immediately.

The present invention overcomes the shortcomings of the prior art.

BRIEF SUMMARY OF THE INVENTION

According to an aspect of the present invention, there is provided apparatus for mixing contents of a receptacle, the apparatus comprising: a rotary shaft equipped at a proximal end with a connection for removable attachment to a means of providing rotation. The rotary shaft has a mixing element fixedly connected at a distal end of said shaft opposite to said proximal end. The mixing element comprises at least two arms at the distal most end of said shaft, a corkscrew neck on said shaft and a collar on said shaft positioned in between said at least two arms and said corkscrew neck. Said at least two arms are configured in a first partially-open resting position and are moveable to a second fully-open operative position and said mixing element further comprises a blade positioned across said shaft more proximally than said corkscrew neck.

DETAILED DESCRIPTION OF EXAMPLE EMBODIMENTS

FIG. 1 (Prior Art)

Figure 1:
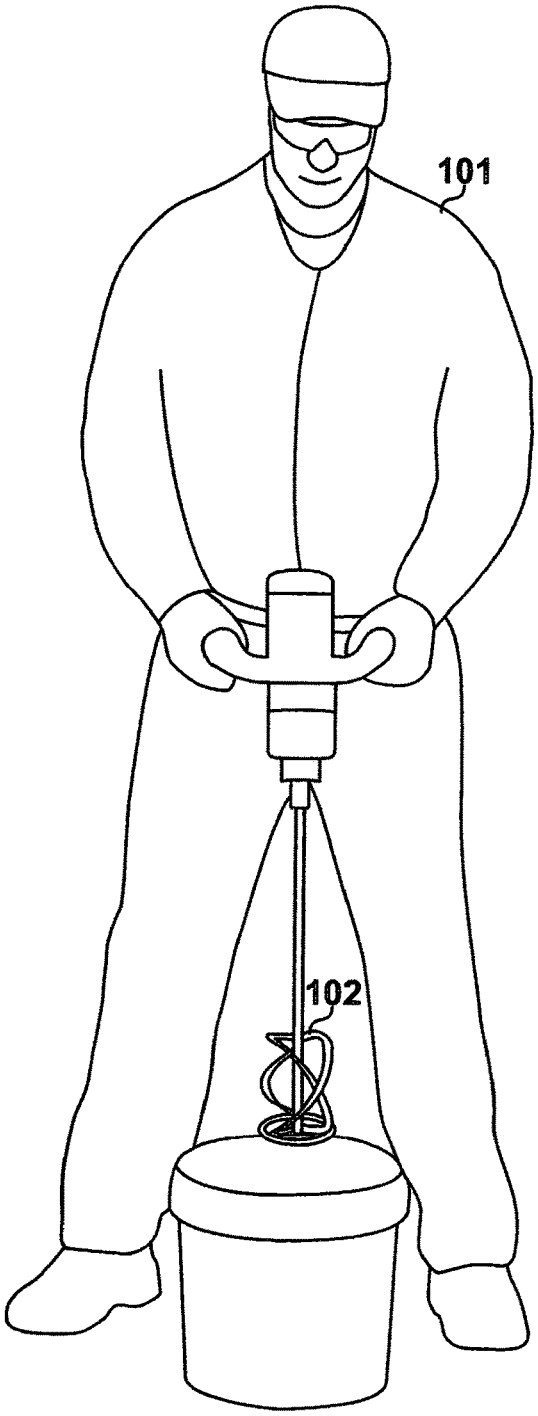
FIG. 1 (prior art) shows a person mixing plaster using a mixing device of the prior art.

A person 101 mixing plaster using mixing apparatus 102 of the prior art is shown in FIG. 1. Mixing apparatus 102 does not ensure complete stirring of dry plaster powder and water in a receptacle. Unmixed plaster powder remains around the interior rim of the mixing receptacle and on the surface of the contents inside the receptacle. Mixing apparatus also takes a relatively long time to mix plaster. Furthermore, if apparatus 102 is not cleaned immediately after use, plaster dries on the surface of apparatus 101 and can be difficult to clean off at a later stage.

FIG. 2 (Prior Art)

Figure 2:
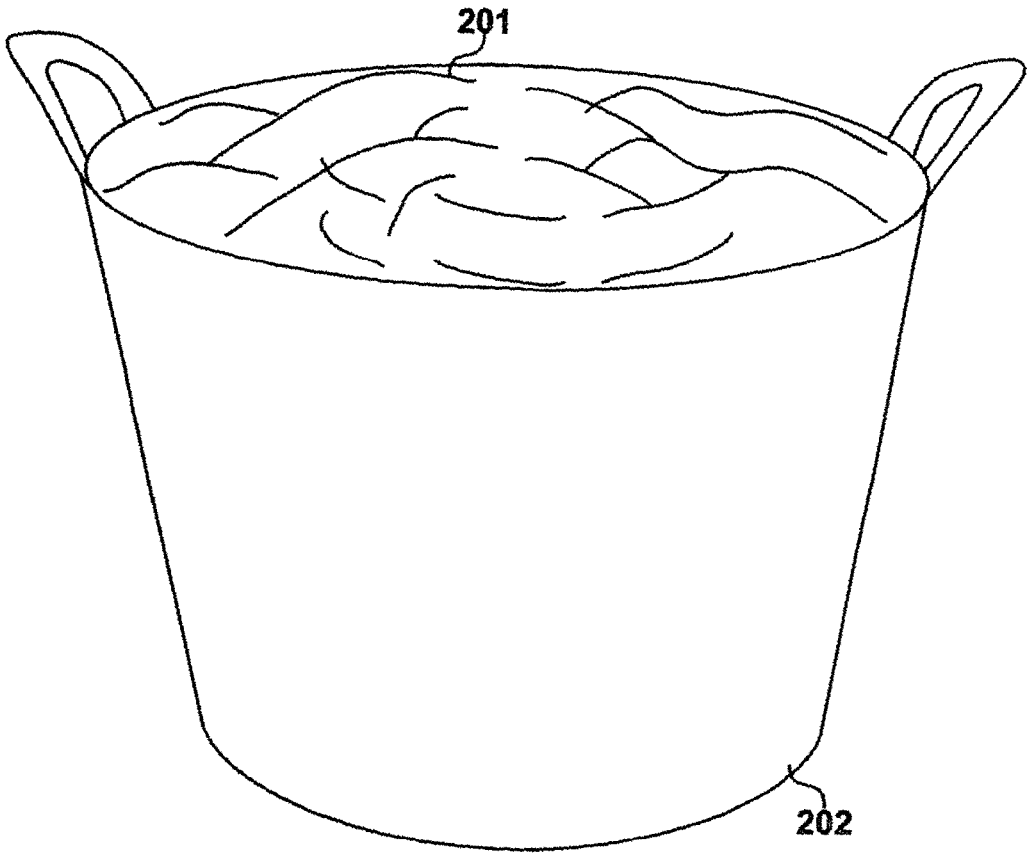
FIG. 2 (prior art) shows the remains of dry plaster in a bucket following mixing with a mixing device of the prior art.

FIG. 2 shows the remains of dry plaster 201 in a bucket 202 following mixing with mixing apparatus of the prior art (for example 102 in FIG. 1).

When mixing plaster, the apparatus of the prior art does not generate a sufficiently strong downwards force during the mixing process, leading to unmixed plaster on the surface of the mix inside the receptacle, and also on the inner circumference of the mixing receptacle.

FIG. 3

Figure 3:
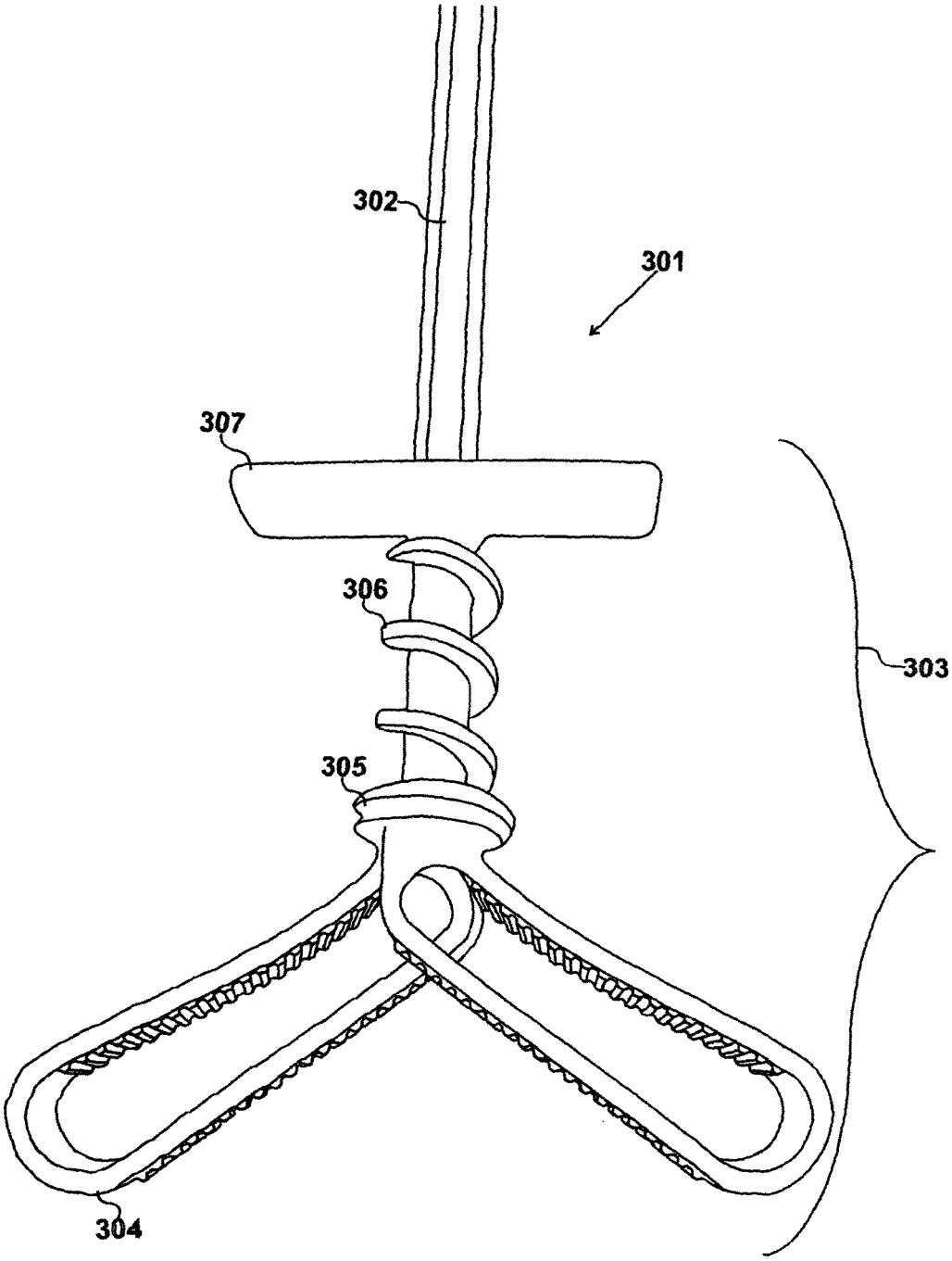
FIG. 3 shows a perspective view of the claimed apparatus embodying the present invention.

FIG. 3 shows a perspective view of the claimed apparatus embodying the present invention. The present invention provides an improved mixing tool 301 comprising a metal hexagonal shaft 302. In the illustrated embodiment, shaft 302 is fabricated from steel. Shaft 302 has a proximal end with a connection for removable attachment to a means of providing rotation, such as a handheld drill. Shaft 302 has a distal end to which mixing element 303 is attached.

Shaft 302 has a mixing element 303 comprising at least two arms 304, a corkscrew neck 306 encircling shaft 302 and a collar 305 positioned in between said at least two arms 304 and corkscrew neck 306. Blade 307 is positioned adjacent corkscrew neck 306 and in the illustrated embodiment is affixed at 90 degrees to main shaft 302 of tool 301. The components of mixing tool 301 are fabricated from a heavy nylon, such as a mixture of nylon and urethane. Such a mixture affords characteristics of flexibility and durability and any mixture providing these characteristics would be suitable to be used in the present invention. Tool 301 overcomes the disadvantages of the prior art.

Firstly, tool 301 provides enhanced mixing by ensuring that no unmixed material, for example, dry plaster, remains on the surface of the mixture or around the inner rim of the mixing bucket.

Figure 4:
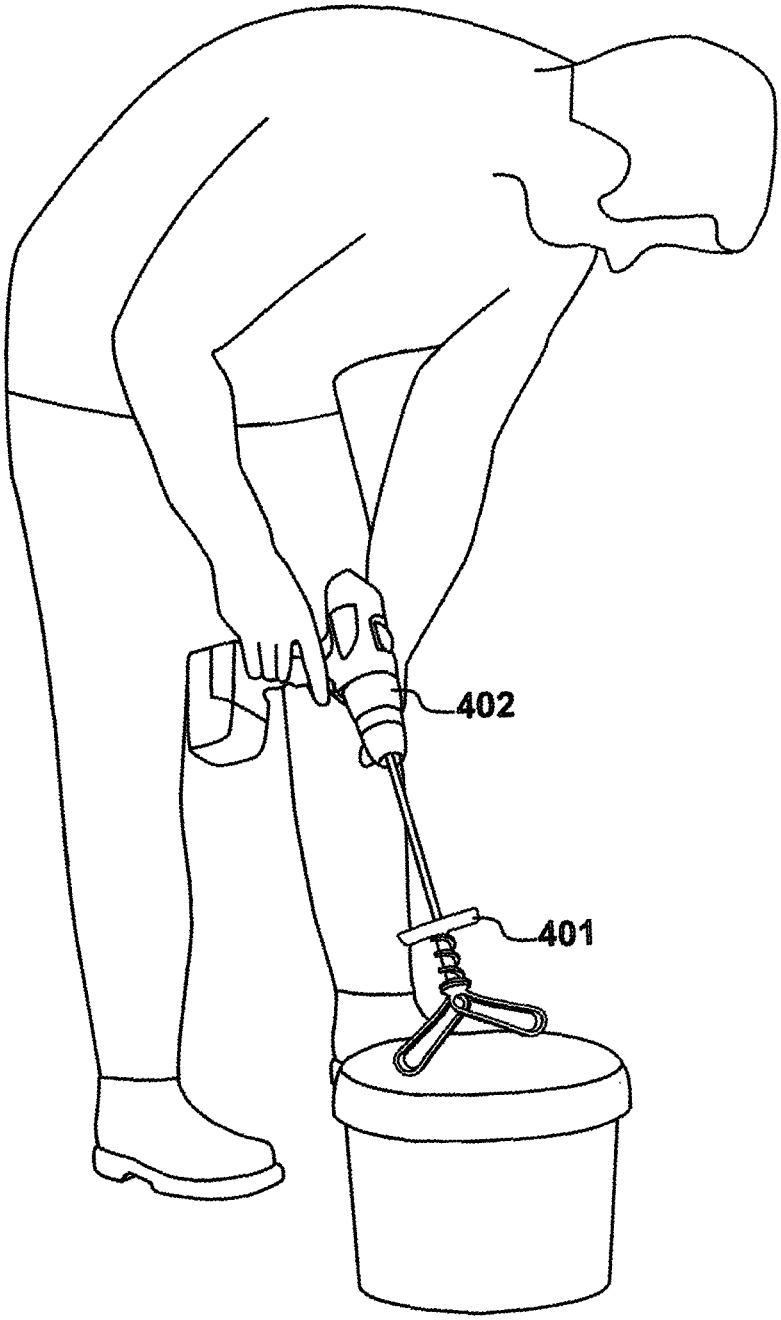
FIG. 4 shows a person using the apparatus embodying the present invention in conjunction with a handheld drill.

Secondly, tool 301 can be used with a low speed drill (as described further in FIG. 4). In particular, the means for providing rotation may be a handheld drill capable of operating at speeds of 200-300 revolutions per minute. In contrast, the means for providing rotation in the prior art (such as EP2638955A1) is typically a handheld drill, capable of operating at speeds of 600-1100 revolutions per minute.

Thirdly, tool provides a device which not only gives an enhanced degree of mixing but also mixes in a shorter period of time. As an illustration, using prior art techniques for mixing plaster, for example, a paddle, it takes between approximately five and six minutes to mix a 40 kg container of plaster. In contrast, the present proposal can mix a 40 kg container of plaster in approximately one minute.

Fourthly, tool provides significant time and labour saving advantages in the cleaning of device. Tool can simply be placed in a bucket of water/solvent and the means of providing rotation activated in order to be cleaned. As an illustration, a 60 kg container of plaster can be mixed using tool 301 and then tool cleaned within three minutes and twenty seconds. This is significantly less time than the time taken to only mix (and not clean) a tool of the prior art, such as a paddle. If tools of the prior art, such as a paddle, are left unclean, they may rust. This then leads to problems of contamination of mixes with rust particles and/or dried pieces of plaster falling from the tool into mixes. Furthermore, such prior art tools when left in an unclean state are often hit or tapped against the floor or a wall to remove the dried-on mix. This then leads to damage to the tool such as shattering or fracturing, which then leads to an imbalanced tool and subsequent damage to the mixing bucket.

FIG. 4

FIG. 4 shows a perspective view of the claimed apparatus 401 embodying the present invention in conjunction with a handheld drill 402. Handheld drill 402 is an example of a means of providing rotation, and any other means may be used, such as an electric screwdriver. In the prior art, namely, the means for providing rotation is typically a handheld drill, capable of operating at 600-1100 revolutions per minute. Thus, a handheld drill capable of operating at high speed must be used in conjunction with the mixing apparatus of the prior art. In contrast, the tool embodied in the present invention may be used in conjunction with a handheld drill capable of operating at speeds of merely 200-300 revolutions per minute. Therefore, drills capable of operating at much lower speeds may be used in conjunction with the improved mixing tool embodied in the present invention. Advantageously, when using a lower speed drill, smaller quantities can be mixed. This leads to less wastage of plaster when only small amounts are required.

FIG. 5

Figure 5:
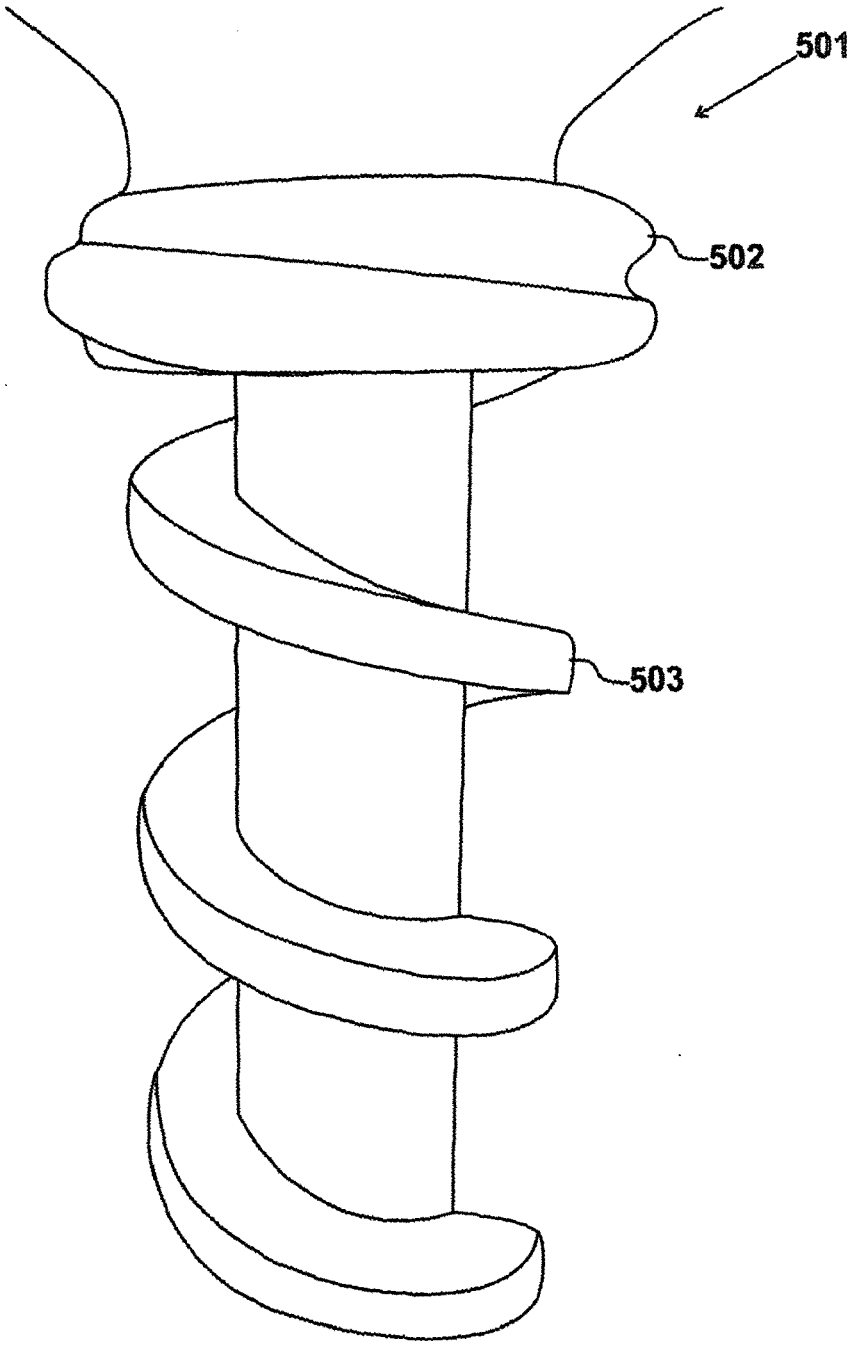
FIG. 5 shows a further perspective view of the claimed apparatus embodying the present invention.

FIG. 5 shows a further perspective view of the claimed apparatus two features which serve to prevent plaster (or other material being mixed) moving up the device during mixing. These are important features to reduce the creation of mess during mixing and to reduce the amount of product lost from the mixing container.

Collar 502 lies directly adjacent the at least two arms and comprises an angled deep grooved channel around the main shaft. The angle of the channel helps material that is moved upwards to be driven into the channel and then back down again into the container.

Corkscrew neck 503 lies more proximally on the shaft and directly adjacent to collar 502. Corkscrew neck 503 therefore lies in between collar 502 and the blade (not herein shown). Corkscrew neck 503 comprises an anticlockwise spiral and therefore when the drill (not shown) is rotating the shaft in a clockwise direction, any loose material coming up the shaft is driven back down under a vortex. Therefore, anticlockwise spirals are configured in an opposite direction to the way in which the shaft rotates. In the illustrated embodiment, corkscrew neck comprises three complete spirals. However, in alternative embodiments, there may be less than three or more than three spirals.

FIG. 6

Figure 6:
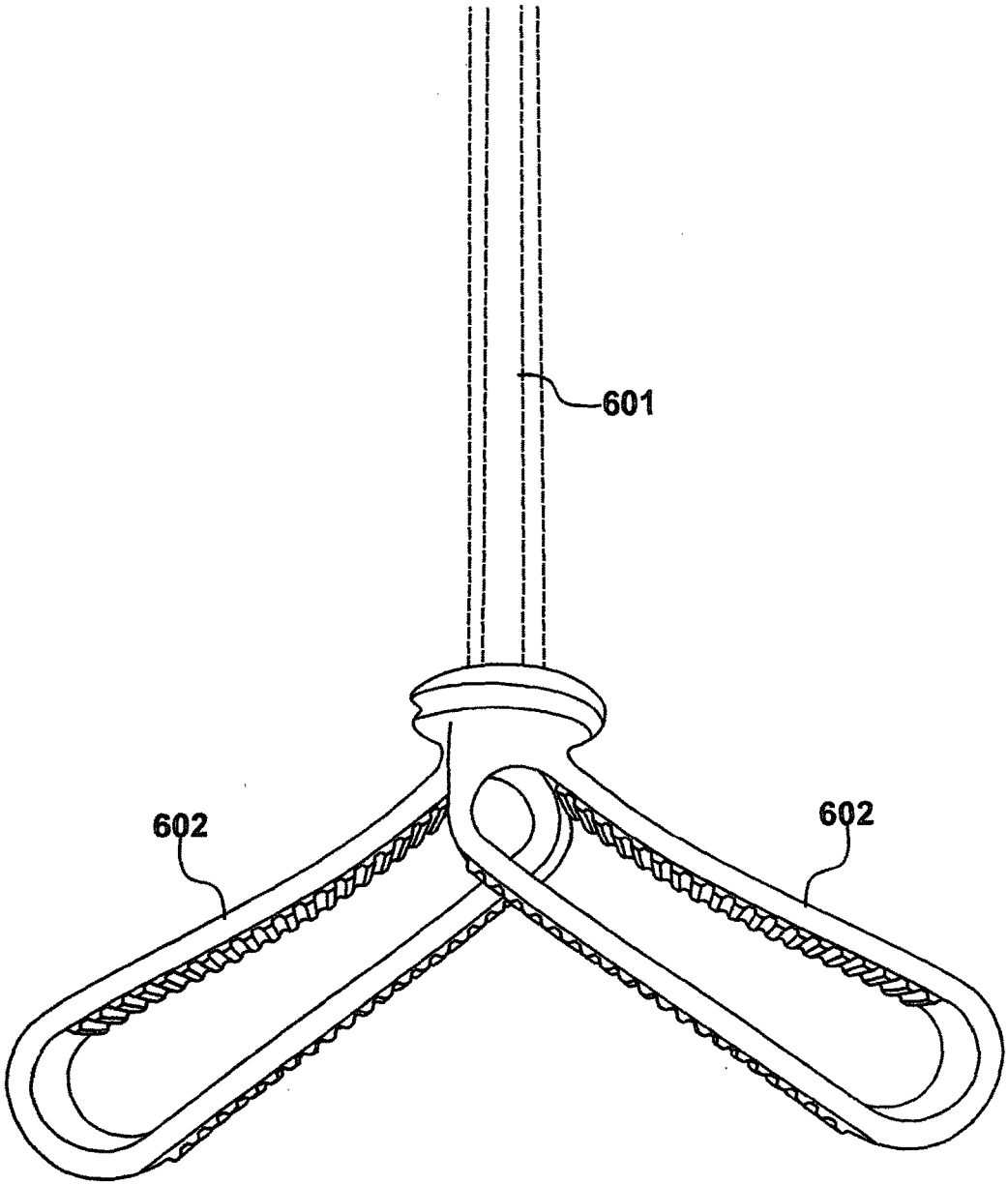
FIG. 6 shows a further perspective view of the claimed apparatus embodying the present invention.

FIG. 6 shows a further perspective view of the claimed apparatus embodying the present invention. The end of the shaft 601 (opposite to the end having the point of attachment for the handheld drill) comprises at least two arms. In the illustrated embodiment, there are precisely two arms 602 fixed at an angle of 45 degrees from shaft 601. Arms 602 are capable of spreading outwards when the handheld drill (not herein shown) is in operation to reach a maximum angle of 90 degrees from shaft 601. At lower speeds of approximately 200 revolutions per minute, arms 602 remain in their resting position of 45 degrees to the main shaft. At higher speeds of approximately 400 revolutions per minute, arms open to reach the maximum angle of 90 degrees from the shaft.

Since arms 602 only fully open at speeds of approximately 400 revolutions per minute, there is therefore a reduced load on the motor at lower speeds, and this extends the potential lifespan of the motor, such as that in the handheld drill (not shown in FIG. 6).

FIG. 7

Figure 7:
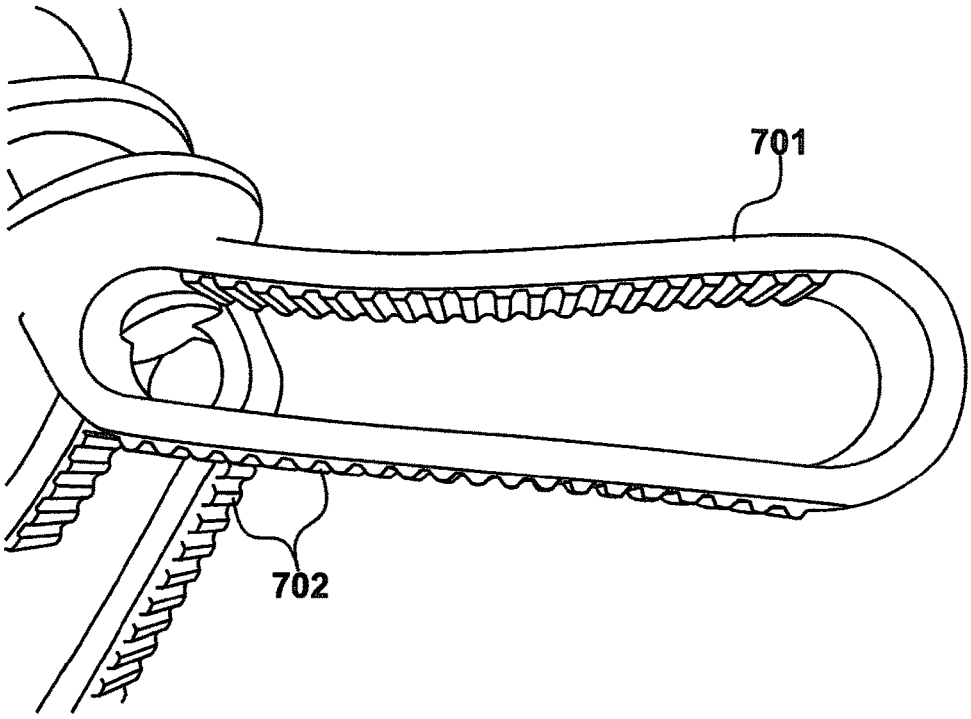
FIG. 7 shows a further perspective view of the claimed apparatus embodying the present invention.

FIG. 7 shows a further perspective view of the claimed apparatus embodying the present invention. In the illustrated embodiment, arms 701 display raised sections or ridges 702 on at least one surface, and in particular, on at least one exterior surface and on at least one interior surface. Raised sections or ridges 702 function to increase agitation of the mixture and thereby enhance mixing. Additionally, raised sections/ridges 702 serve to speed up dispersion of the dry mixture.

FIG. 8

Figure 8:
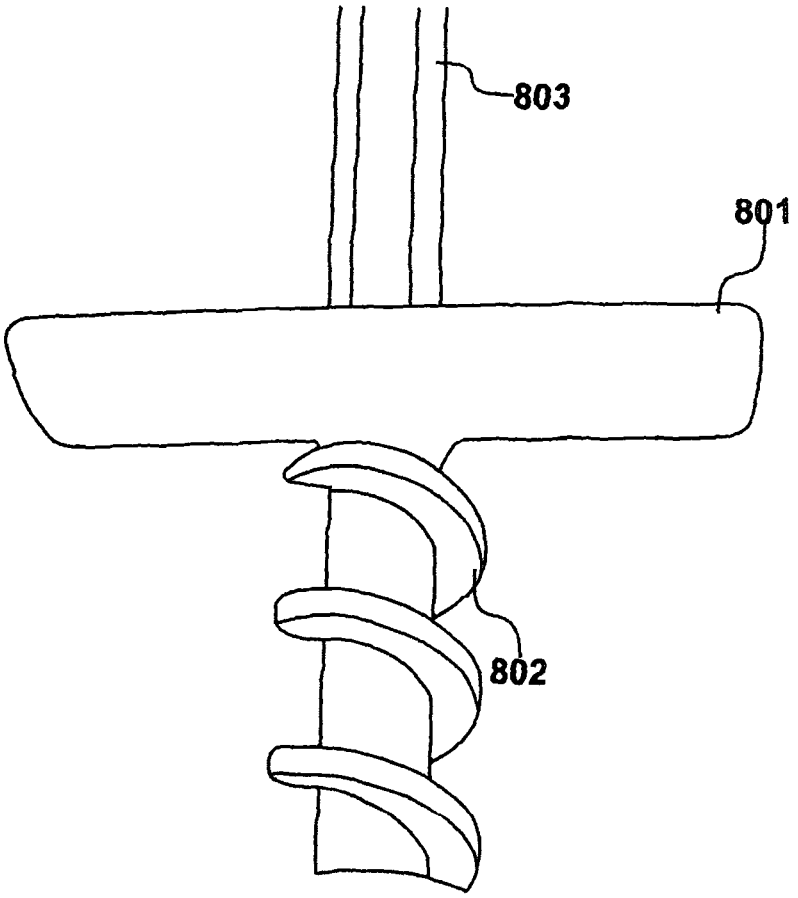
FIG. 8 shows a further perspective view of the claimed apparatus embodying the present invention.

FIG. 8 shows a further perspective view of the claimed apparatus embodying the present invention. Blade 801 is positioned above corkscrew neck 802 and affixed at 90 degrees to shaft 803 of the tool. In the illustrated embodiment, shaft 803 is a hexagonal shaft. Blade 801 serves to create a downwards force within the material being mixed and ensures that unmixed material does not remain on the surface of the mixture or around the rim of the mixing bucket.

What I claim is:

1. Apparatus for mixing contents of a receptacle, the apparatus comprising:

a rotary shaft equipped at a proximal end with a connection for removable attachment to a means of providing rotation, the rotary shaft having a mixing element fixedly connected at a distal end of said shaft opposite to said proximal end, the mixing element comprising at least two arms at the distal most end of said shaft, a corkscrew neck on said shaft and a collar on said shaft positioned in between said at least two arms and said corkscrew neck, wherein said at least two arms are configured in a first partially-open resting position and are moveable to a second fully-open operative position and said mixing element further comprises a blade positioned across said shaft more proximally than said corkscrew neck.

2. Apparatus as claimed in claim 1, wherein said means of providing rotation is a handheld drill or an electric screwdriver.

3. Apparatus as claimed in claim 1, wherein said shaft is a hexagonal shaft.

4. Apparatus as claimed in claim 1, wherein said at least two arms are each configured as a loop.

5. Apparatus as claimed in claim 4, wherein each said loop comprises a ridged region on at least one surface.

6. Apparatus as claimed in claim 5, wherein each said loop comprises a ridged region on at least one interior surface and at least one exterior surface.

7. Apparatus as claimed in claim 1, wherein said mixing element is fabricated from a flexible material.

8. Apparatus as claimed in claim 1, wherein said collar comprises an angled grooved channel encircling said shaft.

9. Apparatus as claimed in claim 1, wherein said cork-screw neck comprises at least one spiral thread running in an anticlockwise direction.

10. Apparatus as claimed in claim 9, wherein said cork-screw neck comprises three spiral threads running in an anticlockwise direction.

11. Apparatus as claimed in claim 1, wherein said at least two arms are connected to said rotary shaft in a partially-open resting position of 45° to said shaft.

12. Apparatus as claimed in claim 11, wherein said at least two arms are configured to open to a fully-open operative position of 90° to said shaft upon rotation.

13. Apparatus as claimed in claim 1, wherein said blade is fixedly connected at an angle of 90° to said shaft.

14. Apparatus as claimed in claim 1, wherein said blade does not extend in length beyond said at least two arms when in their fully-open operative position.

15. Apparatus as claimed in claim 1, further comprising a handheld drill or electric screwdriver.

* * * * *